US007174924B2

(12) United States Patent
Ours et al.

(10) Patent No.: US 7,174,924 B2
(45) Date of Patent: Feb. 13, 2007

(54) METHOD FOR FORMING A TRANSPORTABLE CONTAINER FOR BULK GOODS

(75) Inventors: David C. Ours, Marshall, MI (US); Randall L. Cary, Battle Creek, MI (US)

(73) Assignee: Kellogg Company, Battle Creek, MI (US)

( * ) Notice: Subject to any disclaimer, the term of this patent is extended or adjusted under 35 U.S.C. 154(b) by 0 days.

(21) Appl. No.: 11/340,926

(22) Filed: Jan. 27, 2006

(65) Prior Publication Data

US 2006/0151059 A1 Jul. 13, 2006

Related U.S. Application Data

(63) Continuation of application No. 10/453,059, filed on Jun. 2, 2003, which is a continuation-in-part of application No. 10/280,431, filed on Oct. 25, 2002, now abandoned, which is a continuation of application No. 09/738,854, filed on Dec. 15, 2000, now Pat. No. 6,494,324.

(51) Int. Cl.
*B65B 1/04* (2006.01)

(52) U.S. Cl. ..... 141/10; 141/95; 141/114; 141/316; 53/139.1; 53/469

(58) Field of Classification Search ..... 141/2, 141/10, 18, 67, 94, 95, 114, 314–316; 53/417, 53/434, 436, 469, 479, 136.5, 138.7, 139.1, 53/570, 583
See application file for complete search history.

(56) References Cited

U.S. PATENT DOCUMENTS 3,374,599 A 3/1968 Sanders
3,778,962 A 12/1973 James
3,879,917 A * 4/1975 Bassendale et al. ..... 53/451
4,074,507 A 2/1978 Ruf et al.
4,113,146 A 9/1978 Williamson
4,136,501 A 1/1979 Connolly
4,219,054 A 8/1980 Carter et al.
4,249,839 A 2/1981 Vance
4,253,507 A 3/1981 Williamson
4,299,076 A 11/1981 Humphrey
4,360,996 A 11/1982 Rutter
4,409,776 A 10/1983 Usui
4,648,432 A 3/1987 Mechalas
4,671,043 A 6/1987 Forni et al.
4,734,292 A 3/1988 Gerardus Van Boxtel
4,753,060 A 6/1988 Furukawa (Continued)

FOREIGN PATENT DOCUMENTS

DE 295 03 132 U1 8/1996

*Primary Examiner*—Timothy L. Maust
(74) *Attorney, Agent, or Firm*—Dickinson Wright PLLC

(57) ABSTRACT

A method for filling a container with a plurality of particles includes the step of filling a radially flexible container through a large diameter with a plurality of particles to a fill level. The method also includes the step of reducing the large diameter of the radially flexible container to a smaller fill diameter in vertical relationship to the fill level as the fill level rises during filling of the flexible container. The method also includes the step of varying the vertical relationship between the fill level and the smaller fill diameter in response to the density of the particles.

5 Claims, 15 Drawing Sheets

U.S. PATENT DOCUMENTS

| | | | | |
|---|---|---|---|---|
| 4,781,475 | A | 11/1988 | LaFleur | |
| 5,353,936 | A | 10/1994 | Dockstader et al. | |
| 5,507,859 | A | 4/1996 | Kaiser | |
| 5,544,472 | A | 8/1996 | Koskinen et al. | |
| 5,566,530 | A | 10/1996 | Johnstone et al. | |
| 5,567,048 | A | 10/1996 | Hammonds | |
| 5,573,044 | A | 11/1996 | Mechalas | |
| 5,787,945 | A | 8/1998 | Riemersma | |
| 6,131,766 | A | 10/2000 | King et al. | |
| 6,324,818 | B1 | 12/2001 | Morness et al. | |
| 6,343,459 | B1 | 2/2002 | Seaward et al. | |
| 6,918,225 | B2 * | 7/2005 | Ours et al. | 53/139.1 |

* cited by examiner

METHOD FOR FORMING A TRANSPORTABLE CONTAINER FOR BULK GOODS

CROSS-REFERENCE TO RELATED APPLICATIONS

This application is a continuation of application Ser. No. 10/453,059 filed on Jun. 2, 2003, for A TRANSPORTABLE CONTAINER AND METHOD FOR FORMING THE CONTAINER, which was a continuation-in-part of application Ser. No. 10/280,431, for a TRANSPORTABLE CONTAINER filed Oct. 25, 2002 now abandoned, which was a continuation of application Ser. No. 09/738,854, for a TRANSPORTABLE CONTAINER FOR BULK GOODS AND METHOD FOR FORMING THE CONTAINER, filed on Dec. 15, 2000, now U.S. Pat. No. 6,494,324.

BACKGROUND OF THE INVENTION

This invention relates generally to a container for transporting bulk goods and, more particularly, to a transportable container comprising a bag for receiving fill material and a spirally wound outer wrap for stabilizing the bag.

Typical containers utilized for transport of bulk particulate fill material are inefficient, do not have a very large volume, and often require a large amount of manual labor be used in filling and handling of the container. Also these containers are typically stacked on top of each other during handling and transport without stabilization resulting in damage to the material. In addition, storage and disassembly of these products requires a large amount of labor and physical plant space.

Johnstone. et al. discloses in U.S. Pat. No. 5,566,530 method for packaging of irregularly shaped articles, flowable granules, or liquids comprising placing an open framework on a pallet to create a space. The space is filled with the material and then a stretch wrap film is wrapped around the material and the framework. Finally the framework is removed from the film.

Williamson discloses in U.S. Pat. No. 4,113,146 a container comprising a spirally wound film to form an inner container, this is surrounded by a middle layer of spirally wound polyester filament, which is in turn surrounded by an single outer wrap sheet. The ends of the inner container are closed with ties and a support sling is located between the middle and outer layers. In U.S. Pat. No. 4,253,507 Williamson discloses a two ply inner tube covered by an over wrap that is bonded to the inner tube. One end of the inner tube is folded and sealed to form a closed bag like structure.

In U.S. Pat. No. 3,374,599 Sanders discloses a method comprising dropping the materials into a container mounted to a conveyor, placing a continuous tubular thermoplastic netting around the container, sealing one end of the netting, then dropping the netting and material out of the container onto a second conveyor where the other end of the netting is sealed. The netting may subsequently be heated to form a firmer package.

In U.S. Pat. No. 5,353,936 Dockstader, et al. discloses a protective tray for use in forming a palletized load of stacked bags of particulate material. The protective tray comprises double wall corrugated cardboard or rigid plastic and in a preferred embodiment it is surrounded by a stretch wrap that encircles the protective tray and the bags.

Connolly discloses in U.S. Pat. No. 4,136,501 a system comprising wrapping a palletized load with a sheet of thermoplastic netting material. Finally, Humphrey discloses in U.S. Pat. No. 4,299,076 a system for wrapping a stabilizing overwrap around a load mounted on a pallet, which is placed on a rotating turntable. The overwrap has a width that is equal to the height of the load and with each rotation the overwrap undergoes successive increasing stages of tension and stretch.

SUMMARY OF THE INVENTION

The invention provides a method for filling a container with a plurality of particles. The method includes the step of filling a radially flexible container through a large diameter with a plurality of particles to a fill level. The method also includes the step of reducing the large diameter of the radially flexible container to a smaller fill diameter in vertical relationship to the fill level as the fill level rises during filling of the flexible container. The method also includes the step of varying the vertical relationship between the fill level and the smaller fill diameter in response to the density of the particles.

DETAILED DESCRIPTION OF A PREFERRED EMBODIMENT

Throughout the present specification and claims the phrase "fill material" is used as a shorthand version of the wide range of products that can be packaged utilizing the present invention. The present invention finds utilization in packaging any material that can be bulk packaged. These items can encompass large bulk packaged pieces as well as very small bulk packaged pieces. Examples of smaller fill materials include, but are not limited to, the following: agricultural products like seeds, rice, grains, vegetables, fruits; chemical products like fine chemicals, pharmaceuticals, raw chemicals, fertilizers; plastics like plastic resin pellets, plastic parts, rejected plastic parts, machined plastic parts; cereals and cereal products such as wheat; a variety of machined parts of all sorts; wood products like wood chips, landscaping material, peat moss, dirt, sand, gravel, rocks and cement. The present invention also finds utilization in bulk packaging of larger fill material including, but not limited to: prepared foods; partially processed foods like frozen fish, frozen chicken, other frozen meats and meat products; manufactured items like textiles, clothing, footwear; toys like plastic toys, plastic half parts, metallic parts, soft toys, stuffed animals, and other toys and toy products. All of these types of materials and similar bulk packaged materials are intended to be encompassed in the present specification and claims by this phrase.

Figure 1:
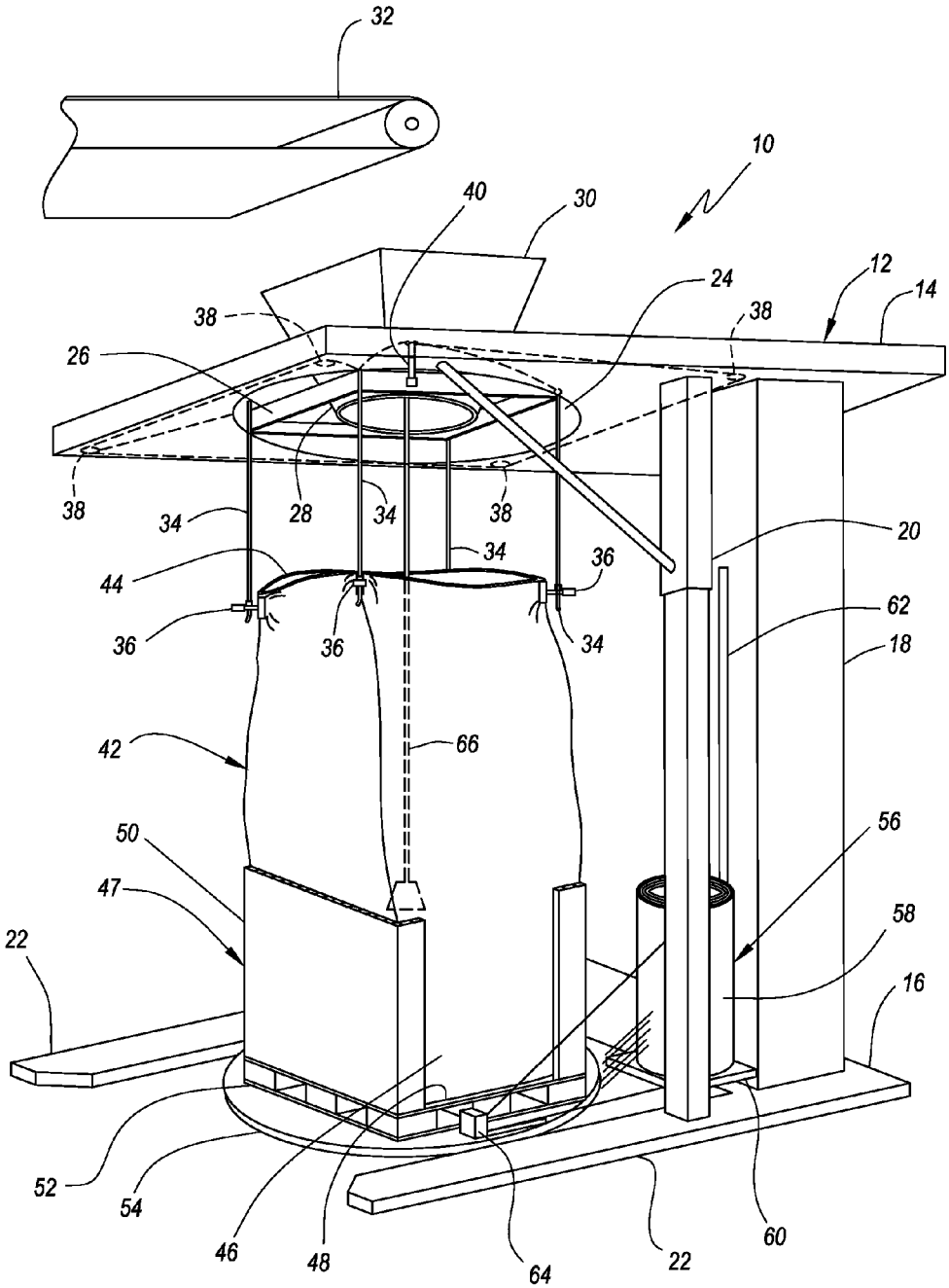
FIG. 1 is a perspective view of one wrapper system according to the present invention with a flexible bag of the present invention in an open position prior to filling and wrapping.

Referring to the Figures, wherein like numerals indicate like or corresponding parts throughout the several views, in FIG. 1, one embodiment of a wrapping system for forming a transportable container for bulk goods designed according to the present invention is shown generally at 10. System 10 includes a frame 12 having an upper support 14 spaced apart from a frame base 16. A first support column 18 and a second support column 20 extend between frame base 16 and upper support 14. Frame base 16 includes a pair of base legs 22. An upper turntable 24 is mounted within upper support 14 of system 10. A support rim 26 is mounted to upper turntable 24 and a fill chute 28 projects through upper turntable 24. A fill funnel 30 is aligned with fill chute 28. A conveyor 32 is aligned above fill funnel 30 for delivering a fill material (not shown) to fill funnel 30. System 10 may comprise a conventional stretch wrapping device such as, for example, a Lantech Q series semi-automatic wrapper.

Extending from upper support 14 are a plurality of cords 34 each of which includes a bag clip 36 at one of its ends. Cords 34 are run through a series of pulleys 38 joined to a crank 40. Rotation of crank 40 moves cords 34 and bag clips 36 up or down relative to upper support 14 depending on the direction of rotation of crank 40. Bag clips 36 are attached to the corners of a flexible bag 42.

Flexible bag 42 includes an open top 44 and a closed base 46. The closed base 46 can be formed into the bag 42 or the bag 42 can be a continuous tubular roll wherein the closed base 46 is formed by folding over the tube or bunching the tube up. The closed base from a continuous tubular roll can also be formed by twisting and tying off a length of the tube which later could be used as a pour spout during subsequent unloading of the fill material 72 (shown in FIG. 2). Preferably, bag clips 36 are attached at a position of approximately 50 to 100 inches down from open top 44. In one embodiment, sufficient length is left to allow the open top 44 to be moved into a folded over position (FIG. 3) so that the bag 42 can be sealed with an outer wrap 58, as described below. Bag 42 is preferably a gusseted bag having dimensions of the closed base 46 of from 40 to 48 inches by from 30 to 40 inches. Preferably bag 42 is from 100 to 190 inches long. For a standard pallet size the bag 42 preferably has a base of about 44 inches by about 36 inches and a length of about 178 inches. Bag 42 can be formed from any food grade material, such as for example, low density polyethylene, high density polyethylene, a food grade polymer, or nylon. The bags can be of a continuous design such as blow molded polyethylene bags or a bag woven from a fiber or plastic. In a preferred embodiment bag 42 is part of a continuous roll of bags 42.

The bag 42 can be formed from a wide variety of flexible materials including, but not limited to: breathable plastics, foils, light blocking materials, laminates, moisture barrier films, paper, and other typical bag materials. In some embodiments it is preferable that the bag 42 be designed with a gusseted bottom thereby creating more of a square shape to the base 46 of the bag 42. The bag 42 can furthermore be color coded for rapid material identification from visual clues. Additionally, the bag 42 may include built in loops to enable easier handling of the bag 42.

In one embodiment, the closed base 46 rests in a bottom support 47. Bottom support 47 can comprise a slipsheet 48 and preferably further includes a shroud 50 when the fill material is very flowable. Slipsheet 48 and shroud 50 can be formed from a variety of known materials, such as for example, corrugated cardboard, plastic, and other similar materials. Shroud 50 preferably has at least two sides and may have more. In addition, shroud 50 may be circular. Shroud 50 can either be attached to slipsheet 48 or it can rest on slipsheet 48. The height of shroud 50 can vary from 4 to 24 inches. Bottom support 47 is mounted to a pallet 52 which rests on a lower turntable 54. Pallet 52 can be formed from metal, wood, plastic, corrugated cardboard and other materials as is known in the art. Preferably the pallet has standard surface dimensions of 40 by 48 inches.

Figure 8:
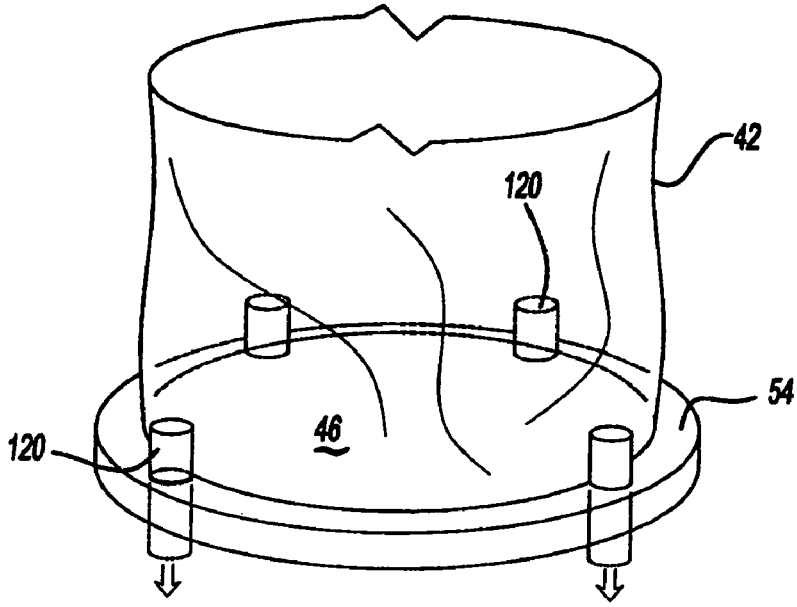
FIG. 8 is a perspective view of our alternative embodiment of a turntable.

In other embodiments, the bag 42 is not associated with a bottom support 47 or a shroud 50. Depending on the fill material, the bottom of the bag 42 may not require additional support, in which case, the bag 42 is simply filled and wrapped with outer wrap 58 in the absence of a shroud 50 or a bottom support 47. In another embodiment, the shroud 50 comprises a strip of corrugated cardboard that is fed around the base 46 of the bag 42 and secured to the bag 42 with the initial wrappings of outer wrap 58. Once the strip of the corrugated cardboard has been placed around the base of the bag 42 the corrugated cardboard is cut and the bag 42 is wrapped with outer wrap 58 as described below. In another embodiment shown in FIG. 8, the bag 42 rests on lower turntable 54 which includes a plurality of fingers 120 that can be extended and retracted. In this embodiment, the fingers 120 are initially extended to provide support to the base 46 of bag 42 during the initial spiral wrapping of outer wrap 58 to provide an initial support to the bag 42. After several wraps of outer wrap 58 the fingers 120 are retracted and the bag 42 is wrapped as described below. In this embodiment, the pallet 52 may or may not be present.

Rotation of lower turntable 54 and upper turntable 24 are synchronized such that they rotate in unison. System 10 further includes a wrap head 56. Wrap head 56 includes a roll of outer wrap 58 and a base 60. Wrap 58 is preferably a stretch wrap having a high cling factor. The wrap 58 is from 50 to 200 gauge; preferably 50 to 150 gauge, and more preferably 90 to 110 gauge and has a width of from 10 to 30 inches. Most preferably, wrap 58 is 100 gauge and has a width of 20 inches. Wrap 58 can be any of a variety of stretch wrap films known in the art. In some embodiments the wrap 58 is slit into a series of strips to reduce costs and weight of the wrap 58. In other embodiments the wrap 58 is a stretch net or webbing to reduce costs and weight of the wrap 58. Wrap head 56 is vertically moveable along a guide rod 62. Wrap head 56 is moved up and down guide rod 62 by a motor (not shown). An outer wrap clamp 64 is mounted to a portion of lower turntable 54. In one embodiment, a fill sensor 66 is retractably extended into flexible bag 42. In FIG. 1, flexible bag 42 is shown in a pre-loading position and open top 44 is in an open position. A portion of the outer wrap 58 is clamped in outer wrap clamp 64. Outer wrap clamp 64 both holds the initial spiral of outer wrap 58 and cuts outer wrap 58 between formation of transportable containers. System 10 also includes a fill sensor 66 to monitor the fill level in bag 42. In one embodiment the fill sensor 66 is an ultrasonic transmitter and receiver, this sensor 66 is used to monitor the top level of a fill material 72 in the bag 42.

In other embodiments, the fill level of the bag 42 is detected in other manners. In one embodiment, the lower turntable 54 further includes a scale and the advancement of outer wrap 58 up the sides of bag 42 is coordinated with the measured weight of the fill material 72 thus allowing the outer wrap 58 to be maintained at or near the fill level. In other embodiments, the system 10 includes a timing mechanism that coordinates the movement of outer wrap 58 based on the known fill rate of bag 42. Alternatively, a sonic probe can be used as a fill level sensor to detect the fill level using sound waves. In either embodiment the fill sensor 66 is an infrared detector, described below.

Figure 2:
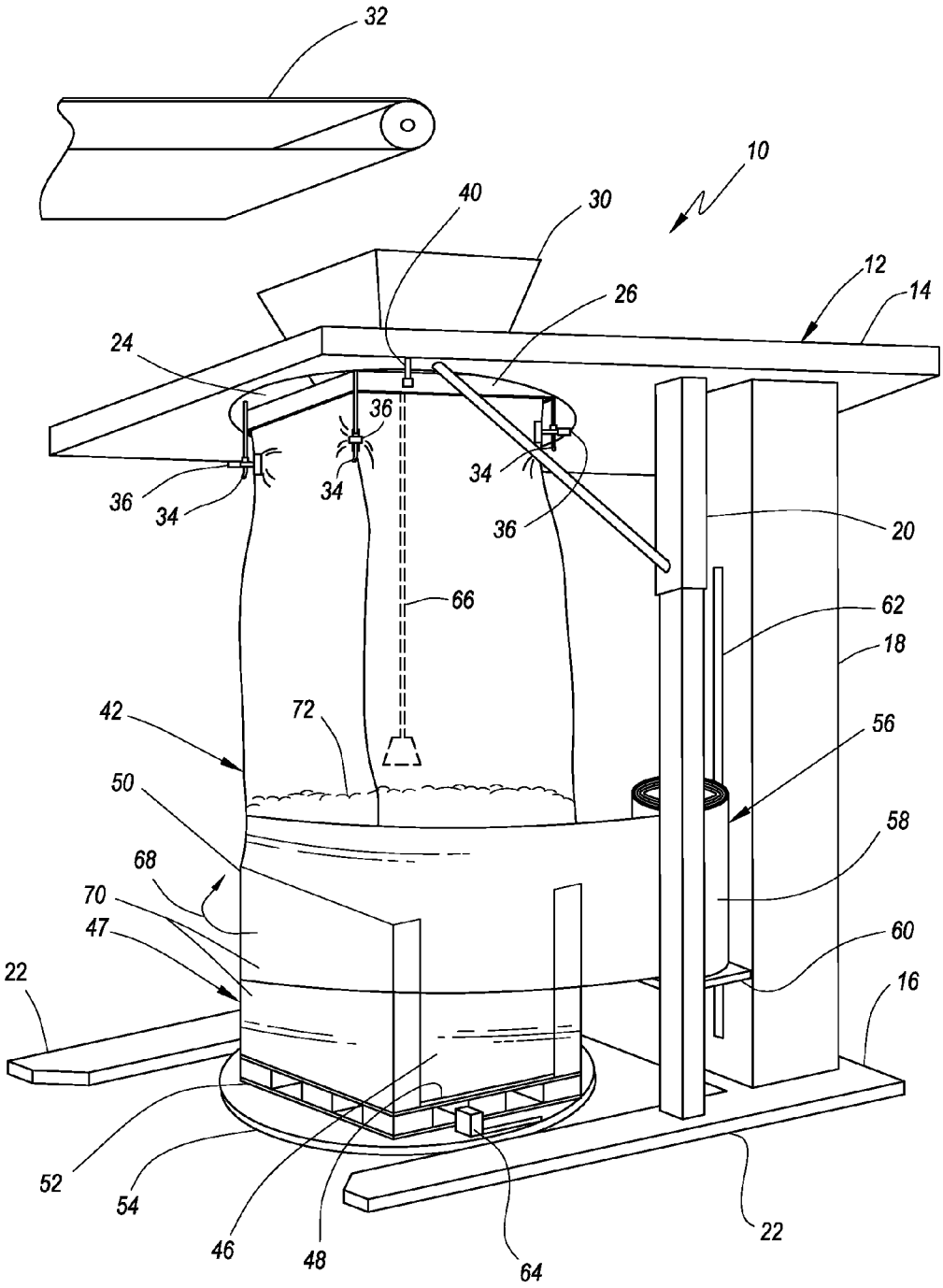
FIG. 2 is a perspective view of the system of FIG. 1 during the filling and wrapping stages.

Once a bag 42 is loaded into system 10 crank 40 is rotated to bring bag 42 to the load position as shown in FIG. 2. As shown in FIG. 2, the upper turntable 24 and lower turntable 54 are rotated in a rotation direction 68 as indicated by the arrow. Initially, the fill material 72 is run into flexible bag 42 through conveyor 32, fill funnel 30 and fill chute 28. Fill sensor 66 or the alternatives discussed above are utilized to detect the height of the fill material 72 within flexible bag 42. As flexible bag 42 fills with fill material 72 the upper turntable 24 and lower turntable 54 are rotated at a speed and the wrap head 56 is moved vertically upward such that the outer wrap 58 is always maintained at a level at or near the top of the level of the fill material 72. With certain fill material 72, such as rice, it may be advantageous to allow the fill material 72 to be above the level of wrap 58 and allow slight bulging of the bag 42 prior to the wrap 58 surrounding the fill material 72. This allows the development of a cone shape to the finished bag 42. For other fill material 72 it is advantageous to keep the wrap 58 level with or slightly ahead of the level of the fill material 72. With low density material the level of the wrap 58 can be plus or minus 12 inches from the fill level, however, for high density material it should be plus or minus 4 inches from the fill level. In an alternative embodiment, the outer wrap 58 can be rotated around a stationary bag 42. As the bag 42 is filled fill sensor 66 is slowly withdrawn from flexible bag 42. The system 10 can be adjusted to provide overlapping layers of outer wrap 58 spaced apart from 0.5 to 15 inches.

As discussed above, the fill material 72 may comprise any bulk packed material such as described above. When loading food products it is preferable that bag 42 be formed of a food grade material, this is not necessary when the fill material 72 is a non-food product. In one preferred embodiment, system 10 is used to fill bag 42 with either a cereal or a ready-to-eat cereal.

For certain types of fill material 72 it can be advantageous to settle the fill material 72 as the bag 42 is being filled. To accomplish this lower turntable 54 can be modified to incorporate a vibratory shaker thereby permitting the lower turntable 54 to settle the fill material 72 as the bag 42 is being filled.

Figure 3:
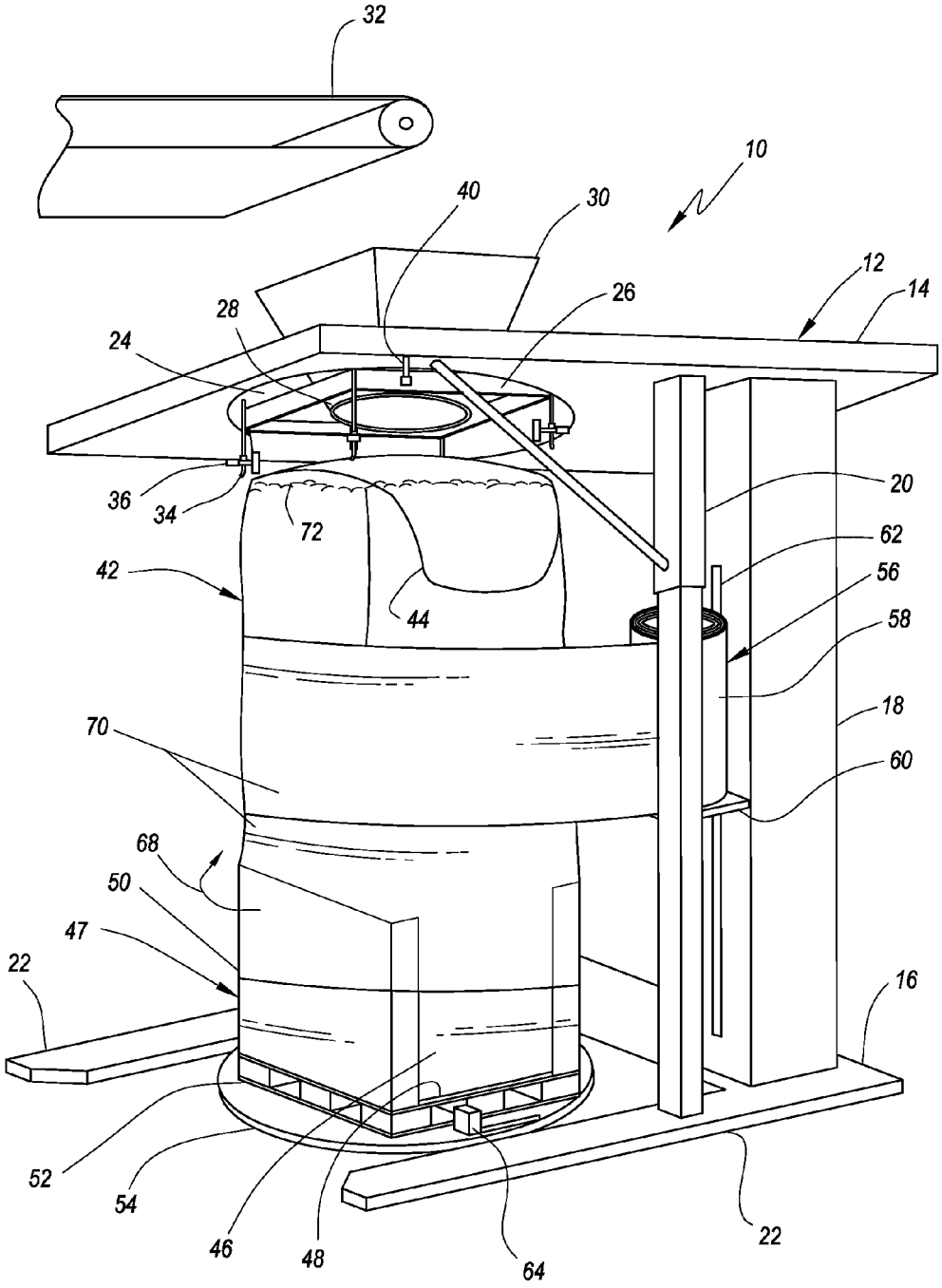
FIG. 3 is a perspective view of the system of FIG. 1 after filling with an open top of the bag in a folded over position.

In FIG. 3 flexible bag 42 is shown in the completely filled condition. In one embodiment, system 10 is stopped at this point in time such that an operator can unclip flexible bag 42 from bag clips 36 and fold over open top 44 into a folded over position as shown in FIG. 3. In this position, the open top is folded over to seal flexible bag 42. Then, system 10 is again initiated and rotation of the upper turntable 24 and lower turntable 54 is commenced again thereby wrapping additional spiral wrappings of outer wrap 58 around flexible bag 42. It is also possible to adjust system 10 such that wrap head 56 is advanced to the top of the particulate material 72 prior to moving open top 44 to the folded over position, such that the folded over portion only receives downward wrappings of outer wrap 58. Alternative methods for closing bag 42 are discussed below.

Figure 4:
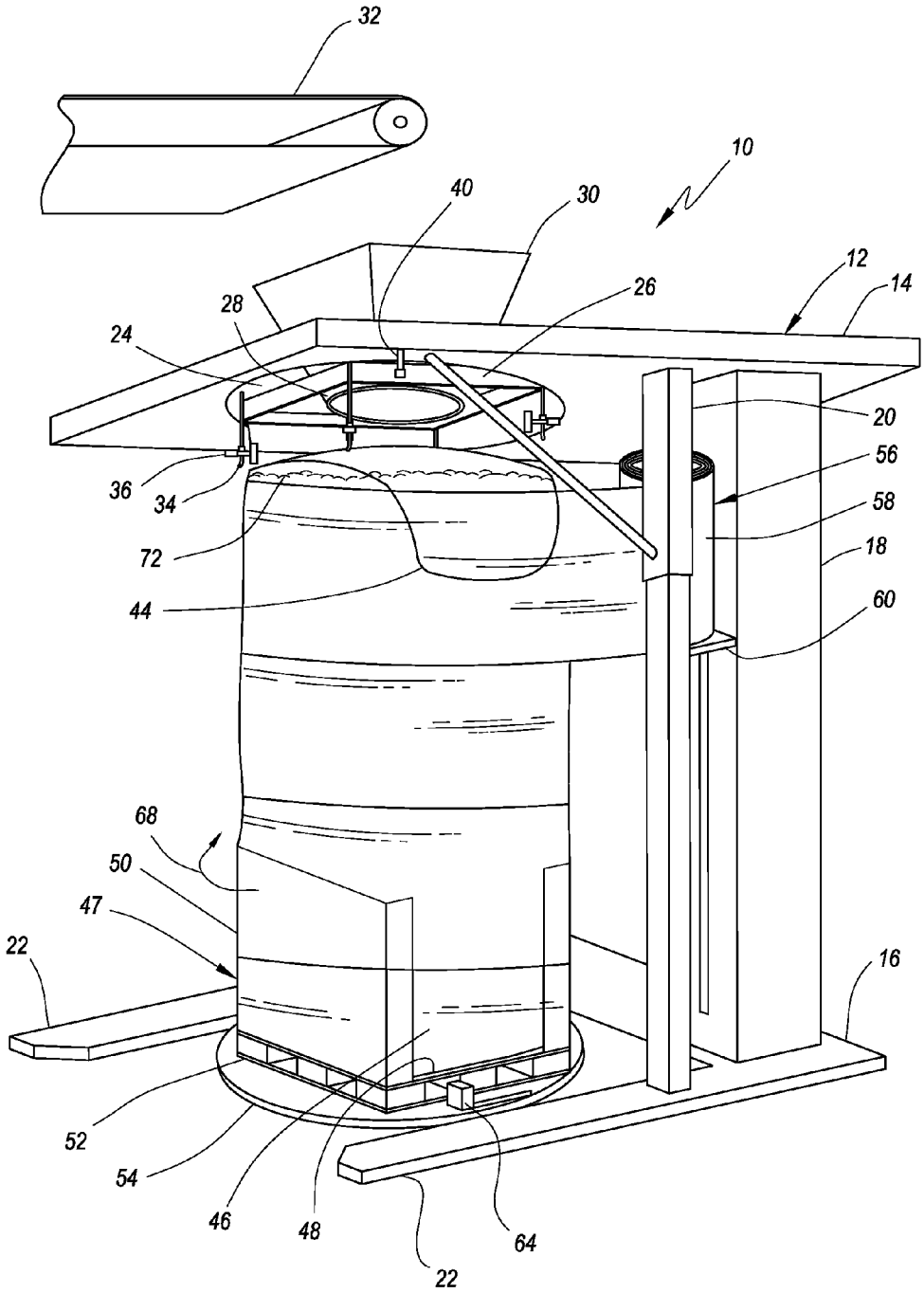
FIG. 4 is a perspective view of the system of FIG. 1 with the bag in the final upward wrapping stage.
Figure 5:
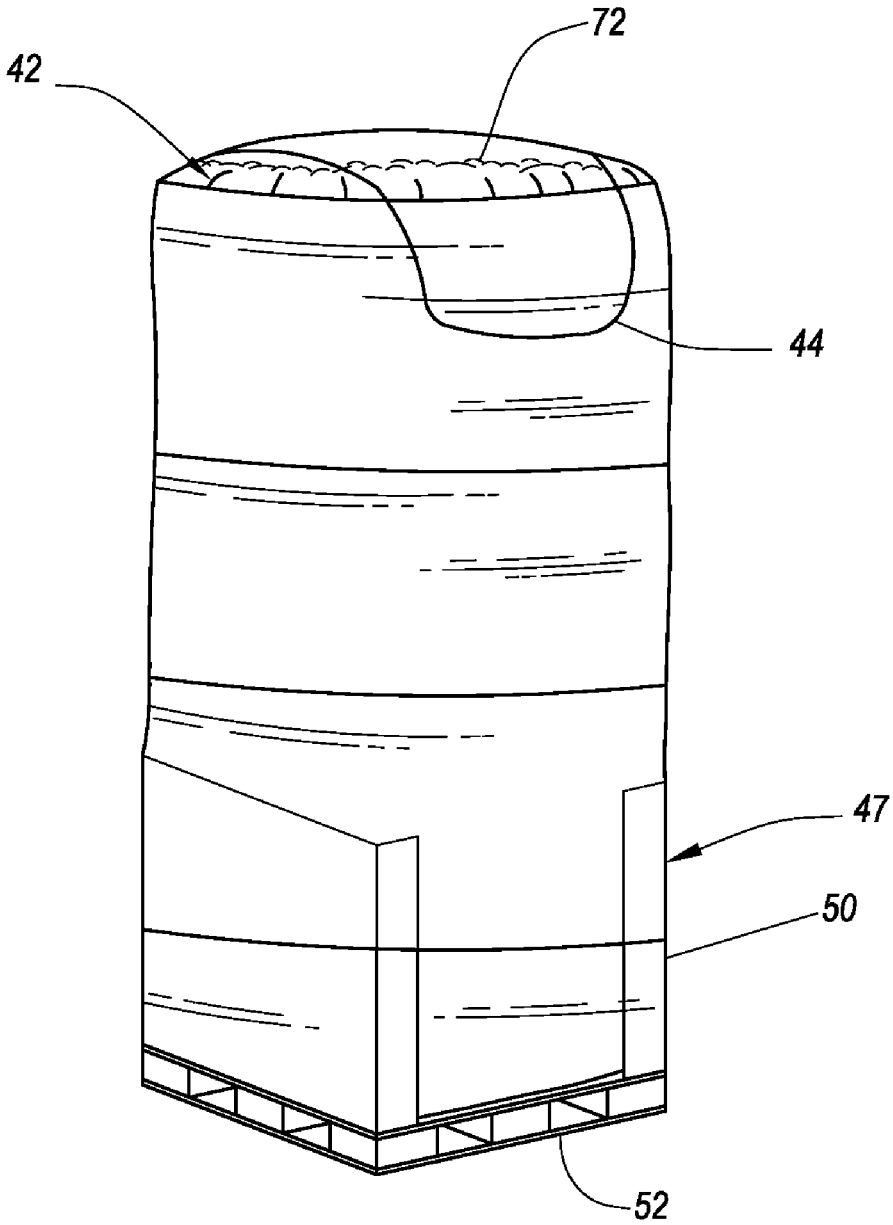
FIG. 5 is a perspective view of the bag in a fully wrapped stage.

In FIG. 4 the system 10 is shown in a position of maximal upward vertical movement of the wrap head 56. In one embodiment, the upper turntable 24 and lower turntable 54 continue to rotate while the wrap head 56 is moved in a vertically downward direction to complete a second wrapping of outer wrap 58 around flexible bag 42. This downward wrapping can be eliminated if desired, although this may require more wrapping on the upward stroke to make the bag 42 rigid. This downward wrapping can be adjusted such that only the bottom support 47 is wrapped to bag 42 or such that pallet 52 is also wrapped to bag 42. In FIG. 5 flexible bag 42 is shown completely wrapped and removed from system 10.

Figure 6:
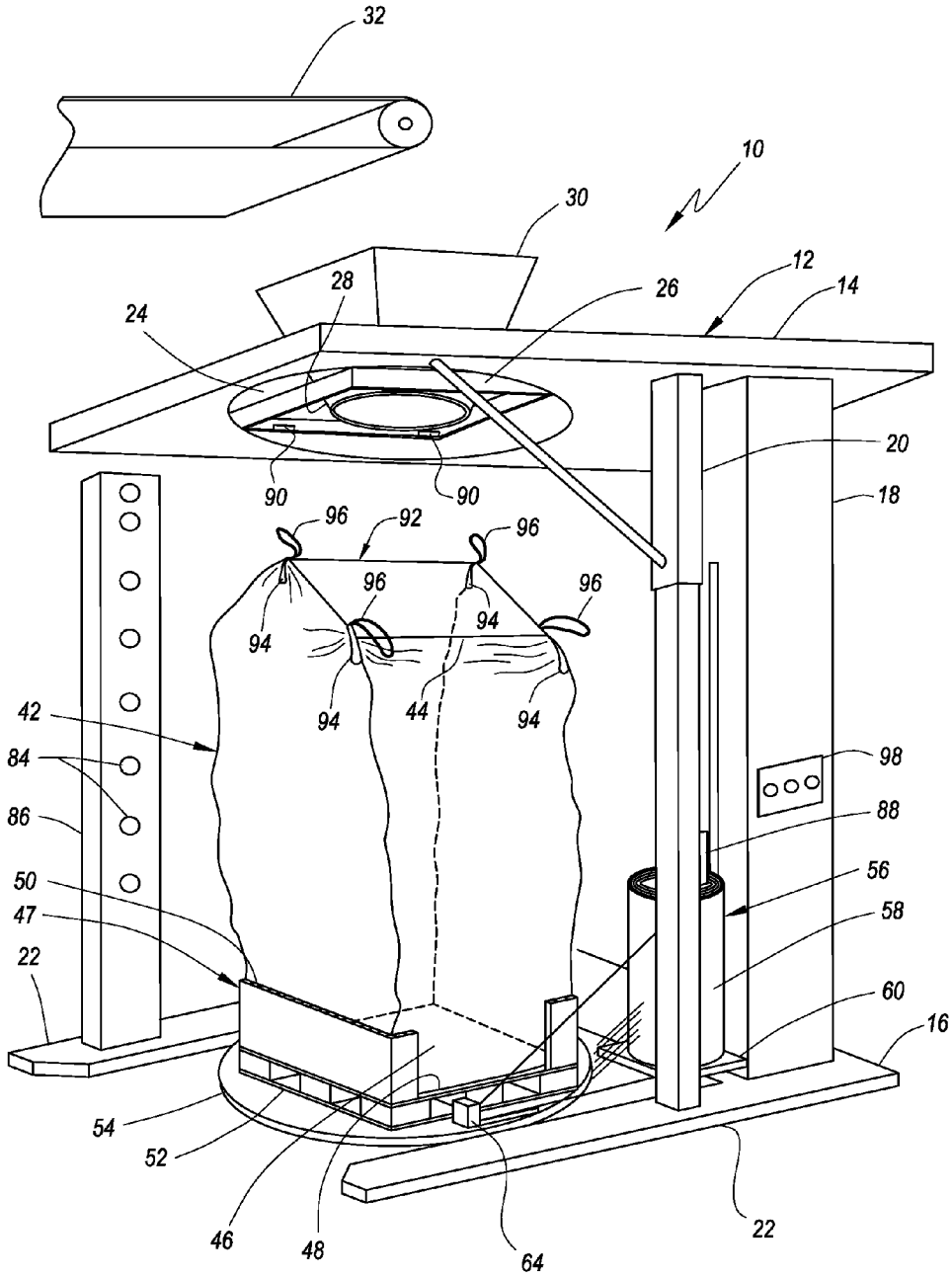
FIG. 6 is a perspective view of an alternative embodiment of the system of FIG. 1.

In FIG. 6 an alternative embodiment of system 10 is shown. In this embodiment, open top 44 of flexible bag 24 is held in an open position by a hoop 92. Hoop 92 includes a plurality of bag holders 94 and a plurality of loops 96 that are received on support rim clips 90 mounted to support rim 26. In this embodiment, system 10 does not include a fill sensor 66 like that described above. Instead system 10 includes a plurality of infrared emitters 84 mounted to a sensor bar 86. Sensor bar 86 is placed across from an infrared detector 88 mounted to wrap head 56. In use, the infrared emitters 84 emit an infrared beam across flexible bag 42 to be detected by infrared detector 88. Thus, infrared emitters 84 and infrared detector 88 serve to sense the level of fill material 72 within flexible bag 42. As in the first embodiment, the upper turntable 24 and lower turntable 54 are rotated as wrap head 56 is moved vertically upward and preferably downward along guide rod 62. The speed of rotation of turntables 24 and 54 are correlated with movement of wrap head 56 along guide rod 62 to ensure that the outer wrap 58 is always approximately level with the top of fill material 72 in flexible bag 42 on the upward spiral. As described above, bag 42 is filled with fill material 72 until it is near the top of flexible bag 42. At this point, hoop 74 is removed from rails 82 and open top 44 can be folded over as shown in FIG. 3. Then the procedure continues as outlined in FIGS. 4 and 5, discussed above.

Figure 7:
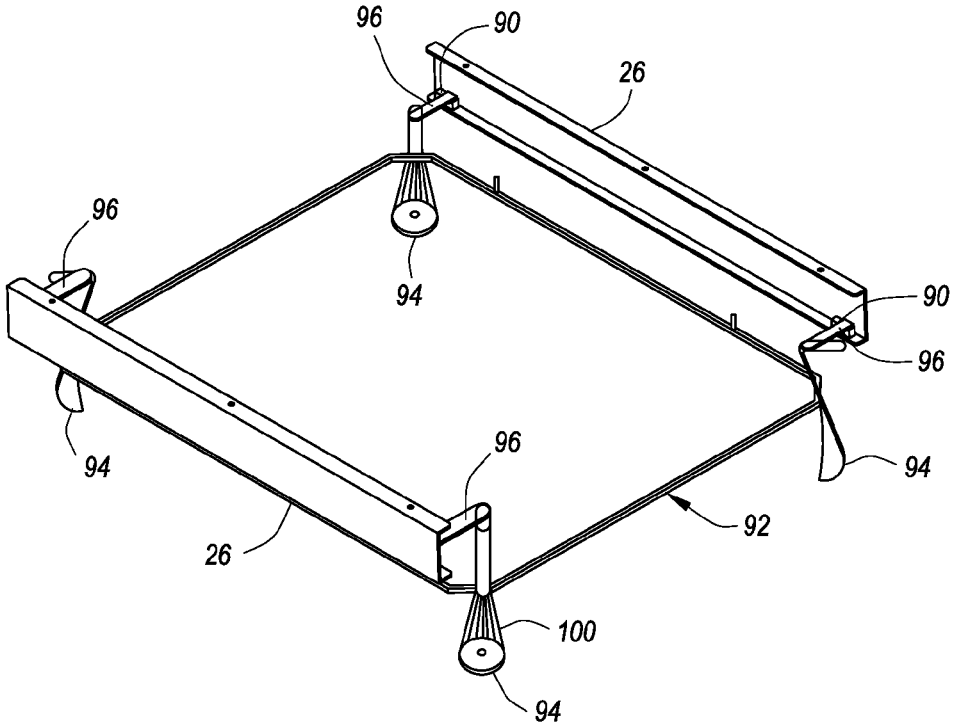
FIG. 7 is a perspective view of a hoop utilized in the alternative embodiment of FIG. 6.

FIG. 7 is a perspective view of hoop 92. The shape of bag holders 94 and loops 96 permit the open top 44 to be bunched while secured to provide sufficient bag to be moved into the folded over position. Preferably bag holders 94 include flexible wire like elements 100 to allow them to be inserted into bag 42 and to then friction hold the bag 42 open.

Figure 9:
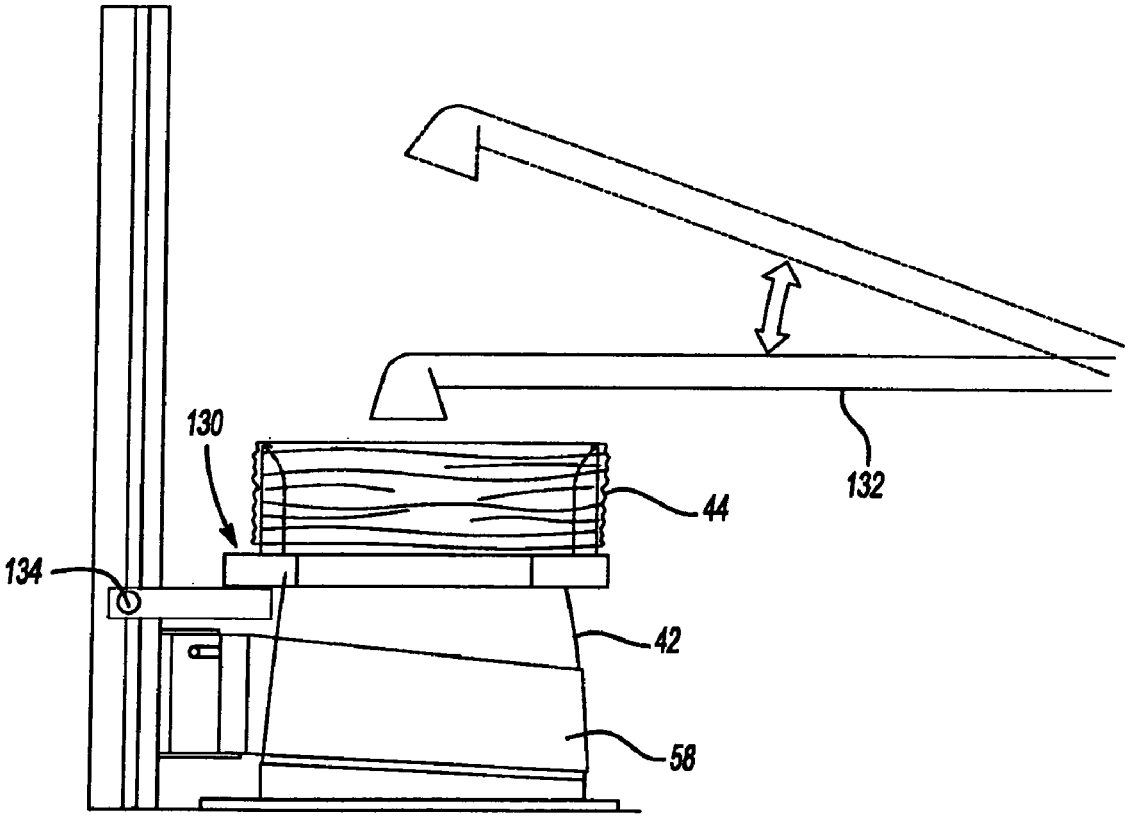
FIG. 9 is a side view of an alternative embodiment of the present invention.

In other embodiments, lower turntable 54, wrap head 56, and base 60 are vertically movable. In this embodiment, during the initial stages of filling bag 42 the lower turntable 54 is placed at a position very close to upper turntable 24. As the bag 42 fills lower turntable 54 is moved in a downward direction to accommodate additional fill material 72. The advantage of this system is that fragile materials have a lower distance to drop from conveyor 32 into bag 42. Movement of lower turntable 54 can be accomplished by any of a variety of mechanisms including scissors platform legs, hydraulic pistons, pneumatic pistons, or a geared mechanism. In an alternative embodiment shown in FIG. 9, the open top 44 of bag 42 is held in a bunched manner by a vertically movable top hat piece 130. The fill material 72 is fed into bag 42 using an articulated conveyor mechanism 132. As bag 42 is filled an outer wrap 58 is spirally wrapped around bag 42, the top hat piece 130 is moved vertically in an upward direction as is the end of the articulated conveyor 132. Again, this design minimizes the drop distance for a fill material 72 as it is loaded into bag 42. Top hat piece 130 can be moved by a gear mechanism 134 or other mechanisms known in the art.

In alternative embodiments, open top 44 can be closed or left open depending on fill material 72. For example, certain fill material 72 such as wood chips, sand, gravel, and other fill material 72, may not require that open top 44 be closed. In such instances, outer wrap 58 would be wrapped around bag 42 in an upward direction to secure fill material 72 in bag 42. Alternatively, open top 44 can be closed in any of a variety of manners known in the art including, but not limited to: sonic or heat welding of open top 44, closure of open top 44 with a plastic pull tie, closure of open top 44 with wire or rope, closure of open top 44 with a clamp, and other closure means known in the art. In embodiments where continuous tubular rolls and sonic or heat welding of the open top are used, the process of sealing the top of one bag can also create the bottom of the next bag. In certain embodiments, it may be advantageous to eliminate the downward spiral wrapping of outer wrap 58 around bag 42. Depending on the type of fill material 72 this may require more spiral wrapping of outer wrap 58 in the upward direction.

In alternative embodiments, it may be advantageous once the bag 42 has been filled with fill materials 72 and outer wrap 58 has been spirally wrapped around bag 42 to include the additional step of placing a nylon strap netting over bag 42. The netting may include a series of loops either at the top or the bottom of the netting to enable the resulting load to handle like a Super Sack®. Moving the unit with the loops rather than the pallet 52 or bottom support would be advantageous in loading cargo ships with a very stable load with the least amount of cost packaging material.

Referring now to FIG. 6, system 10 preferably includes a control panel 98 to permit an operator to control various functions such as stop, start, rotation speed and wrap head 56—movement speed. Such controls are known in the art. System 10 further includes conventional controls to maintain proper fill level, outer wrap 58 force, and sequencing. The relationship of these parameters is constantly monitored and automatically adjusted by means known in the art.

The wrapping of outer wrap 58 about bag 42 generates what are known as hoop forces which apply a gentle squeeze to the fill material 72, helping to support and firm it. The hoop forces stabilize the fill material 72 by promoting controllable contact between the elements of the fill material 72 being loaded into bag 42, thereby promoting bridging between the components of the fill material 72. For example, when the fill material 72 being loaded is a bulk cereal in puff or flake form, hoop forces promote bridging between cereal pieces, thereby reducing the relative motion between the pieces and immobilizing the cereal within bag 42. By using adjustable force settings on the wrap head 56, hoop forces can be tailored to the type of fill material 72 being inserted in bag 42. Hoop forces allow for a very compact and rigid container, which does not allow the fill material 72 to shift or get crushed within bag 42. Bag 42 is filled without any internal frame or support means, since the subsequent removal of such a frame or support means would result in the hoop forces being dissipated and also cause dislodging of the fill material 72 which may result in some of the fill material 72 being crushed. When shroud 50 is used, preferably the sides of shroud 50 are notched and scored in such a way that the hoop forces can be transmitted to the fill material 72 without being absorbed by any corners of the shroud 50 or slipsheet 48.

Figure 10:
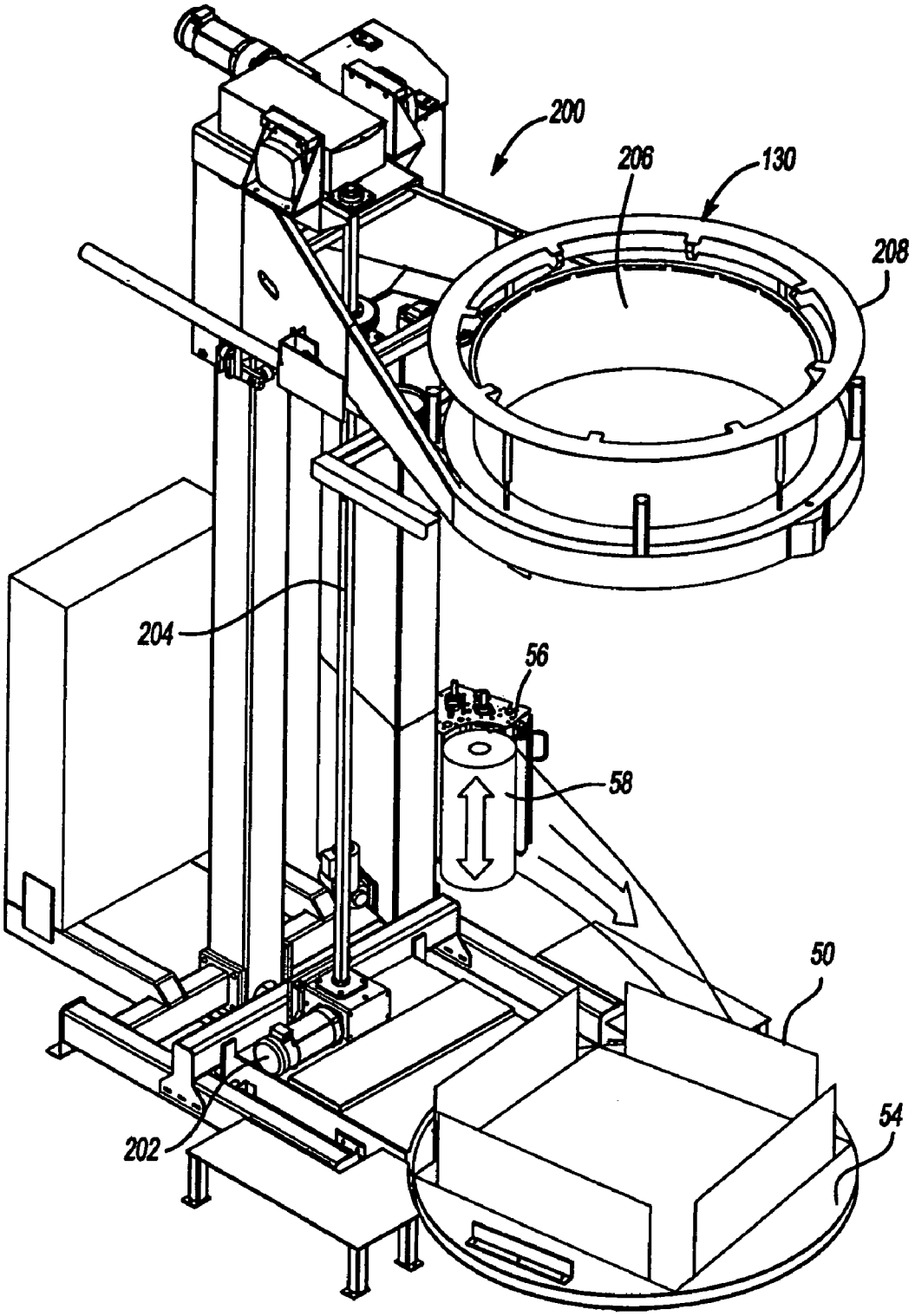
FIG. 10 is a perspective view of an alternate embodiment of the wrapping system.
Figure 11:
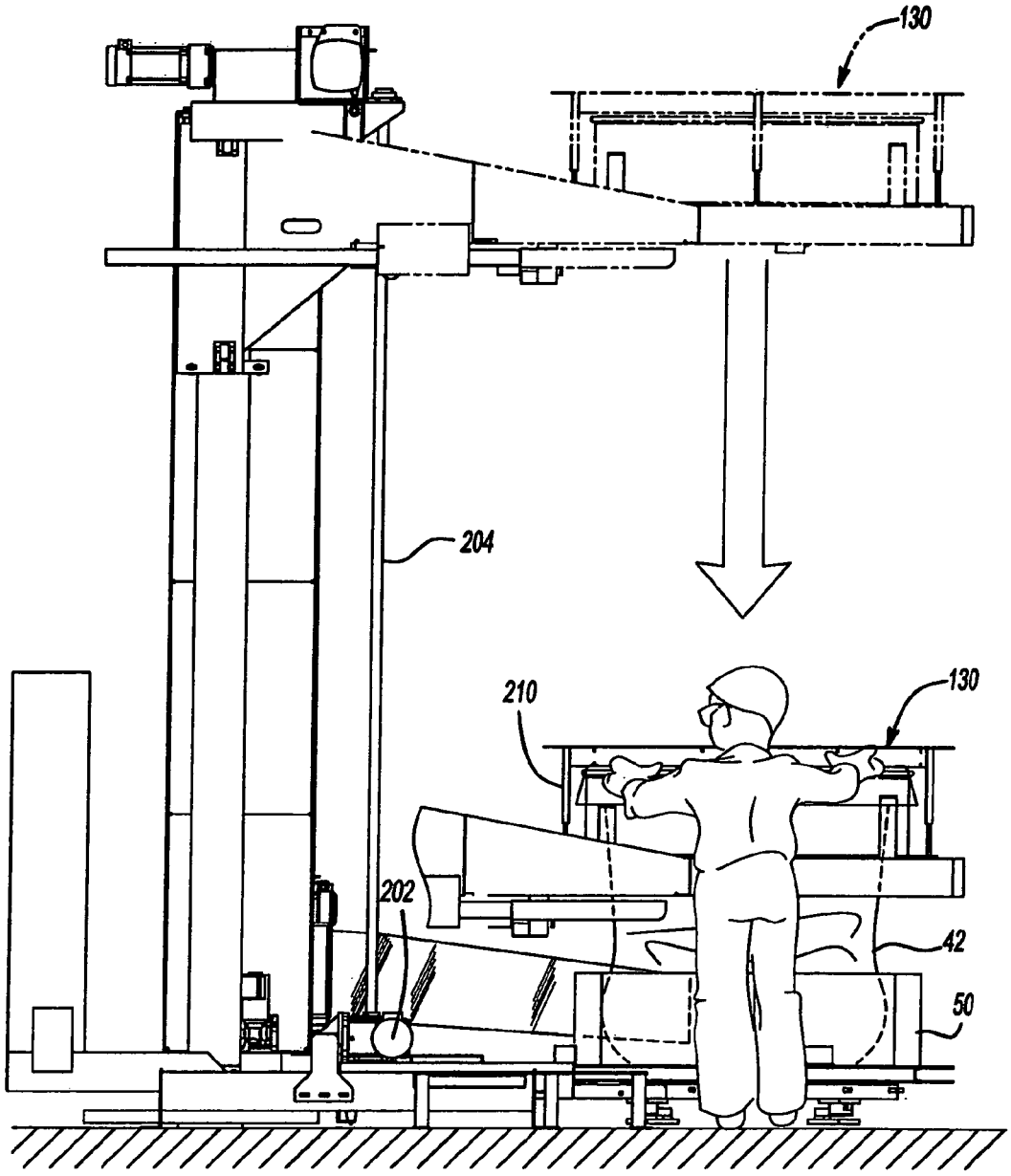
FIG. 11 is a side view of the alternate wrapping system shown in FIG. 10.

FIG. 10 is an alternative embodiment of a wrapping system 200. Wrapping system 200 includes a lower turntable 54, a movable top hat 130, and a wrap head 56 having a roll of outer wrap 58. The top hat 130 and lower turntable 54 are synchronously rotated in unison through a motor 202 and connecting drive shaft 204. Top hat 130 is movable between an upward position as shown in FIG. 10 and a downward position as shown in FIG. 11. The top hat 130 includes an inner rim 206 and an outer rim 208.

Figures 12, 13:
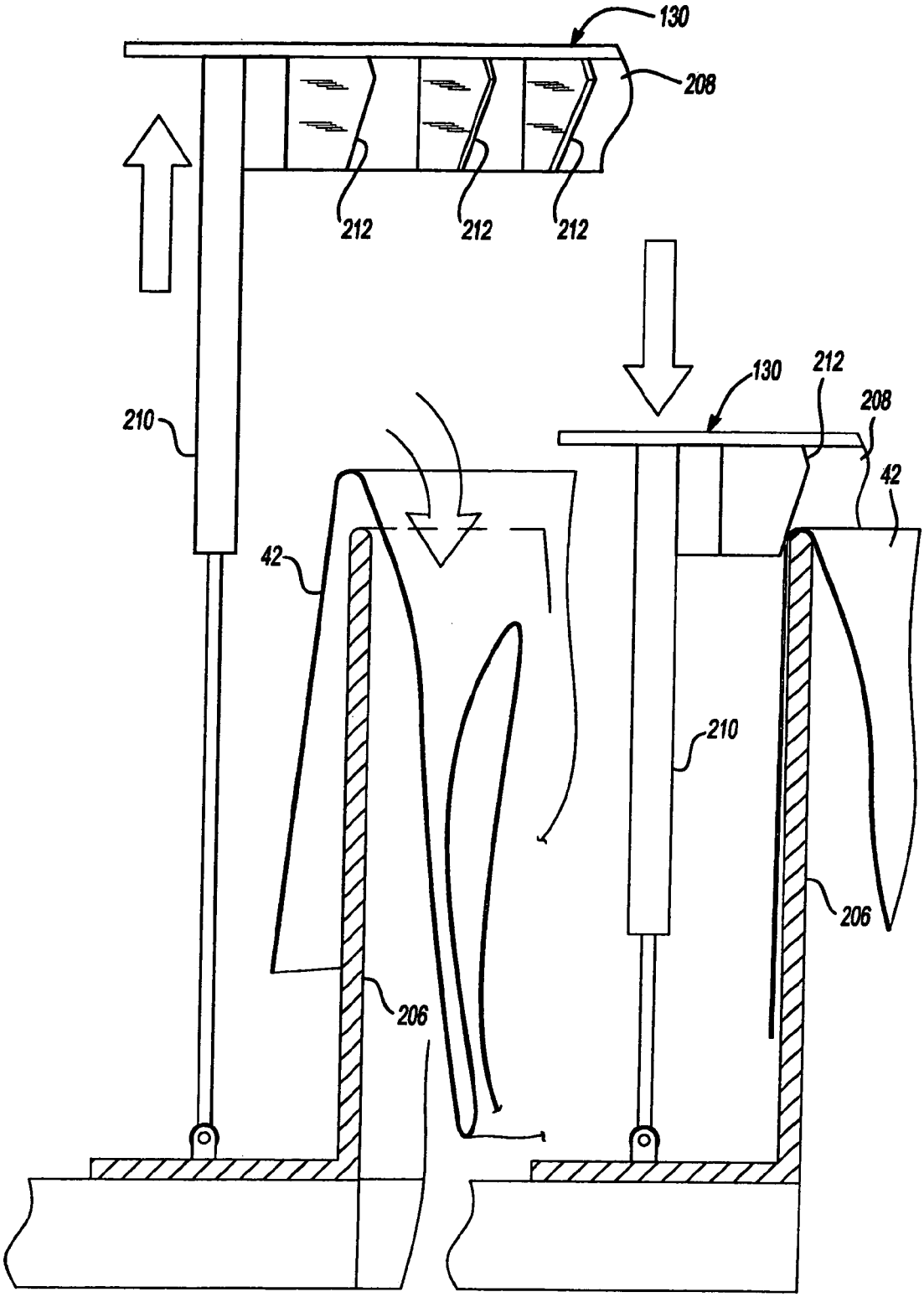
FIG. 12 is a detailed, partial cross-sectional view of structure for maintaining a position of a bag relative to the alternate wrapping system shown in FIG. 10 in an open position.
FIG. 13 is a detailed, partial cross-sectional view of structure for maintaining a position of a bag relative to the alternate wrapping system shown in FIG. 10 in a closed or clamped position.

In FIG. 11 the top hat 130 is shown in the downward loading position. In this position an operator places a bag 42 inside the inner rim 206 and takes the top of the bag 42 over the inner rim 206 and between the inner rim 206 and the outer rim 208. Outer rim 208 is held in an elevated position by a plurality of pneumatic arms 210 such that there is a gap between the outer rim 208 and the inner rim 206. This is shown in FIGS. 12 and 13. In FIG. 12 the outer rim 208 is shown in the elevated position for loading of the bag 42. Outer rim 208 includes a series of pressure points 212 spaced around the inside of outer rim 208. Once the bag 42 has been loaded over inner rim 206 the pneumatic arms 210 are lowered as shown in FIG. 13 and pressure points 212 contact bag 42 and press it against inner rim 206 to hold bag 42 within top hat 130.

Figure 14:
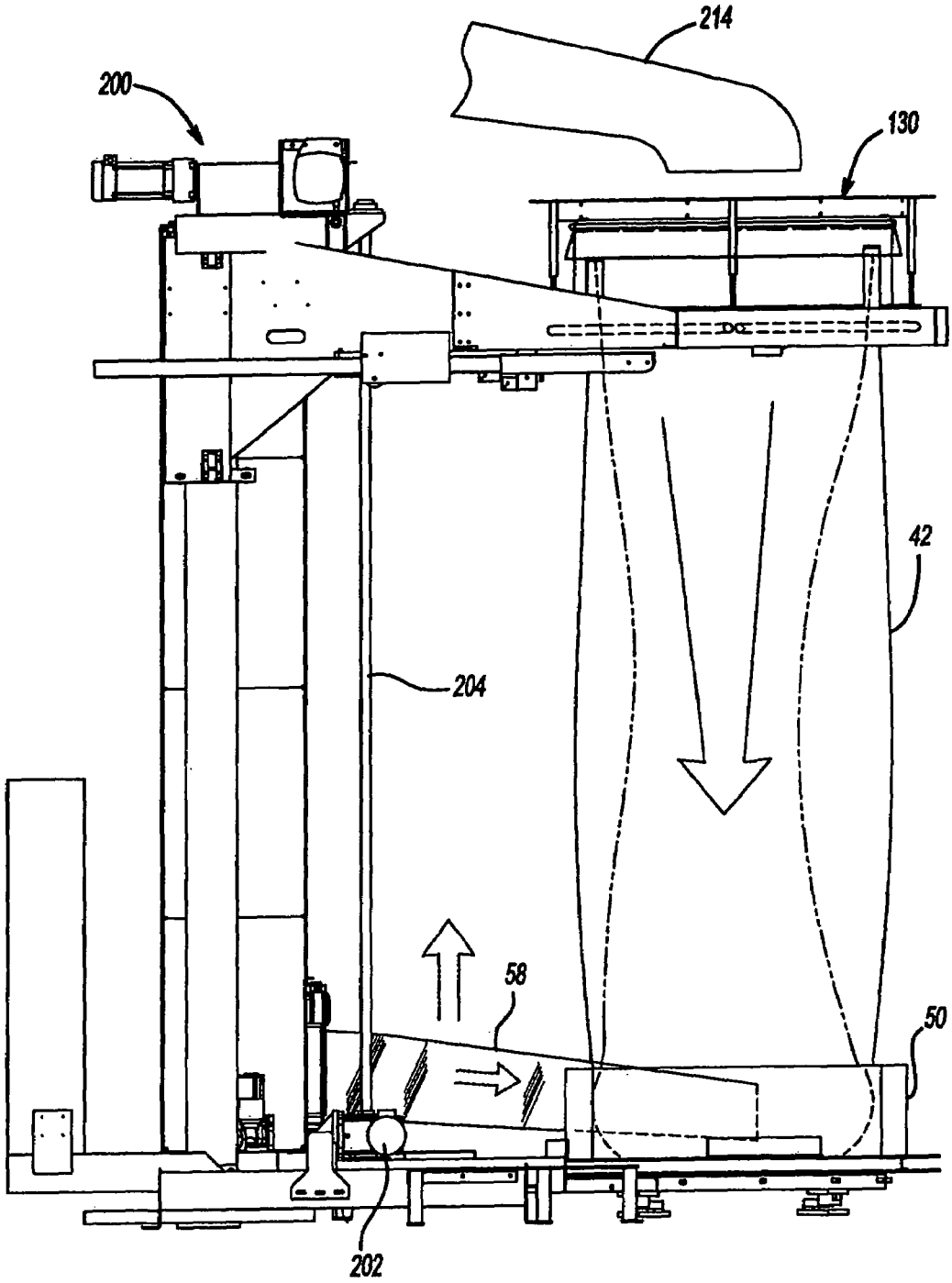
FIG. 14 is a side view of the alternate wrapping system shown in FIG. 10 with a bag in position to receive fill material.

Once the bag 42 has been loaded into top hat 130 the top hat 130 is raised to the upper position as shown in FIG. 14. In the upper position top hat 130 is aligned with a feed chute 214 for providing fill material 72 to the bag 42. Initially, hot air is blown through feed chute 214 to expand bag 42 as shown in FIG. 14.

Figure 15:
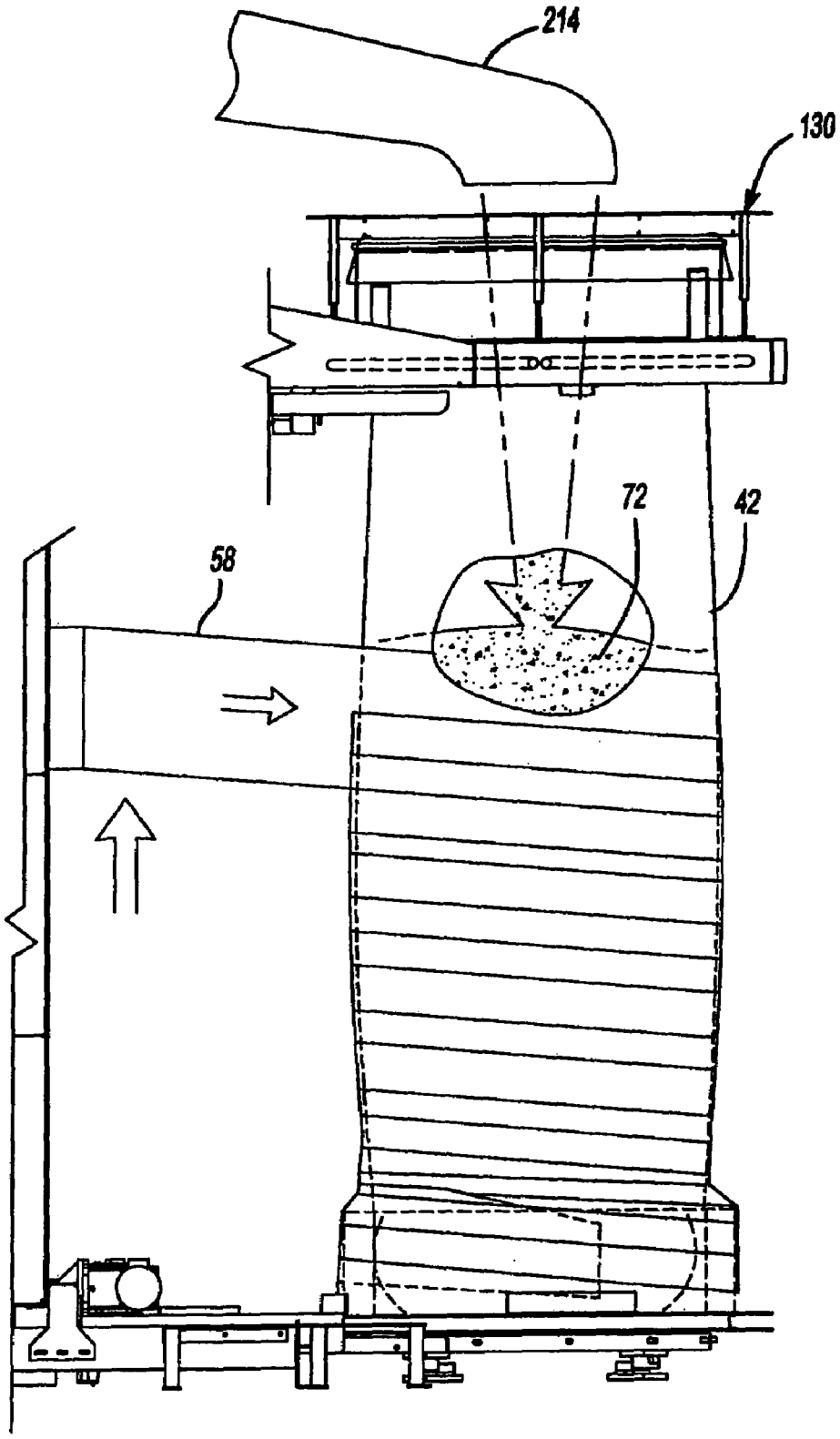
FIG. 15 a side view of the alternate wrapping system shown in FIG. 10 during loading of the bag with fill material.

As described above, the fill material 72 is run into bag 42 and the outer wrap 58 is spirally wrapped around the bag 42 at a position near to the fill level of the fill material 72 as shown in FIG. 15.

If the fill material 72 is a compressible material such as fiber, textiles, fiberglass insulation, etc. it is possible to compress the whole bag 42 vertically prior to sealing the bag 42. The advantage of this design would be to reduce the cubic footprint of the material and thereby reduce shipping costs. The flexible nature of the bag 42, wrap 58, and fill material 72 make this possible. The compressed load can be wrapped vertically using vertical wrappers from Lantech.

Figure 16:
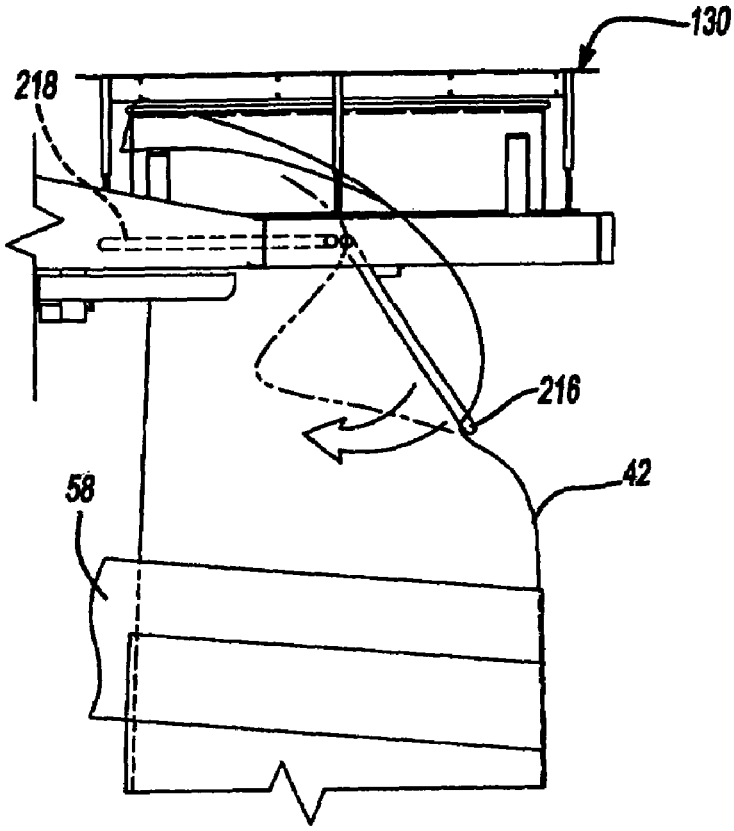
FIG. 16 is a side view of structure for closing an open end of the bag.
Figure 17:
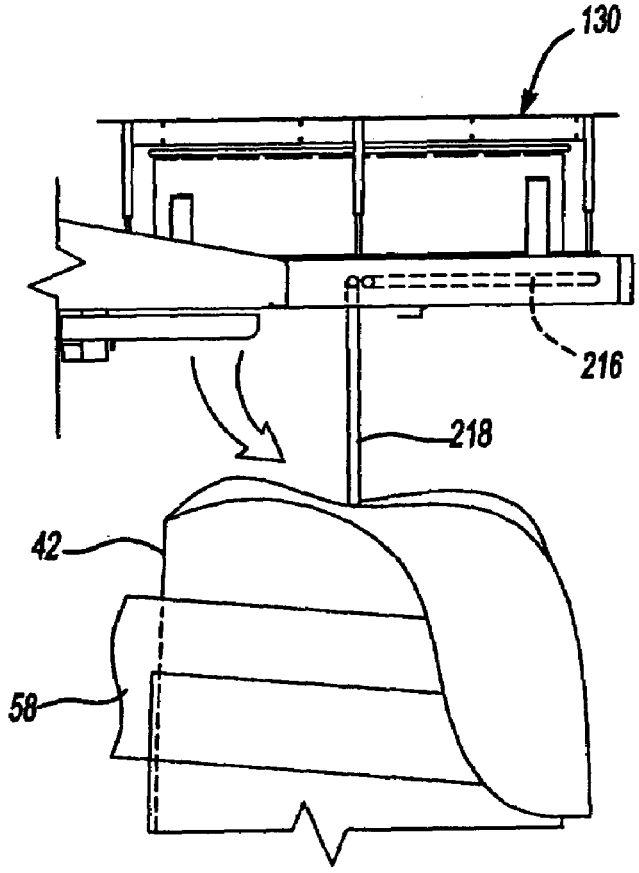
FIG. 17 is a side view of the structure for closing an open end of the bag.
Figure 18:
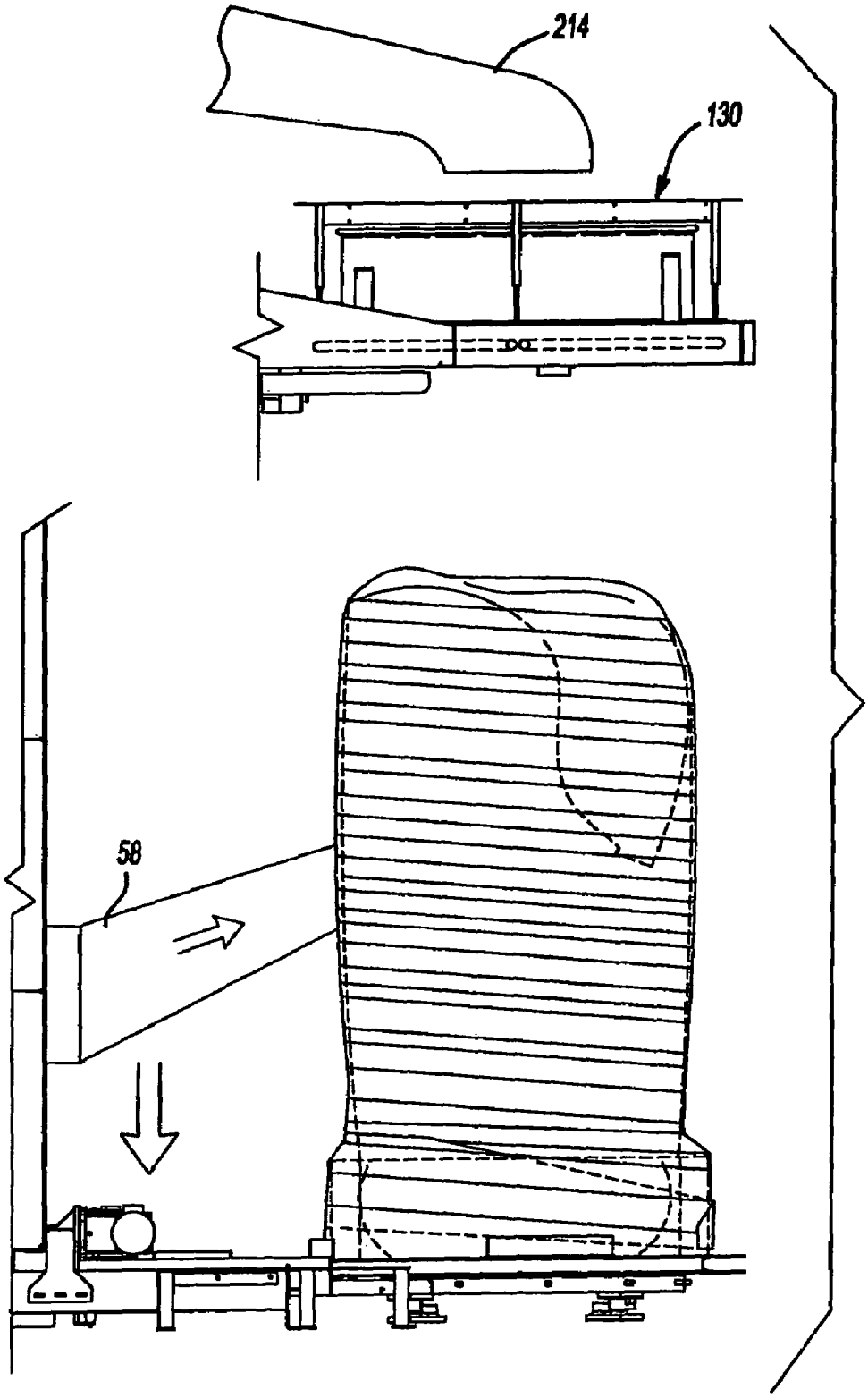
FIG. 18 is a side view of the alternate wrapping system shown in FIG. 10 wherein the wrap head is being moved toward the base of the bag.

As described above, once the fill material 72 is at the proper level in the bag 42 the bag 42 can be closed by a number of different mechanisms and methods, described above, or it can be left open depending on the type of fill material 72. FIGS. 16 and 17 show one mechanism for automatically closing bag 42. The mechanism comprises a first swing bar 216 and a second swing bar 218. The first swing bar 216 is swung against the bag 42 to provide a first crease in the bag and then the second swing bar 218 is swung against the bag to fold the top of the bag over as shown in FIG. 17. At this point, the wrapping of outer wrap 58 is continued in a downward direction as shown in FIG. 18 to produce the final container.

As discussed above, it is possible to utilize the bag 42 with certain types of fill material 72 that do not require a pallet 52 be located below the bag 42 on the turntable 54. In one embodiment, the bag 42 is placed on a pull-pack type slipsheet 58 or shroud 50. Once the bag 42 is filled with fill material 72 a pull-pack type forklift can be utilized to pull the filled bag 42 off the lower turntable 54 and load it into a vehicle for transportation. Such pull-pack slipsheets are known by those of ordinary skill in the art.

The foregoing invention has been described in accordance with the relevant legal standards, thus the description is exemplary rather than limiting in nature. Variations and modifications to the disclosed embodiment may become apparent to those skilled in the art and do come within the scope of the invention. Accordingly, the scope of legal protection afforded this invention can only be determined by studying the following claims.

We claim:

1. A method for filling a container with a plurality of particles comprising the steps of filling a radially flexible container through a large diameter with a plurality of particles to a fill level, reducing the large diameter of the radially flexible container to a smaller fill diameter by wrapping with an outer wrap from a bottom closed end to an open top end in vertical relationship to the fill level as the fill level rises during filling of the flexible container, characterized by:

varying the vertical relationship between the fill level and the smaller fill diameter in response to the density of the particles.

2. The method of claim 1 wherein said varying step includes increasing the vertical relationship in response to decreasing density.

3. The method of claim 1 wherein said varying step includes decreasing the vertical relationship in response to increasing density.

4. The method of claim 1 wherein said varying step includes reducing the large diameter slightly above the fill level.

5. The method of claim 1 wherein said varying step includes reducing the large diameter slightly below the fill level.

* * * * *